US005172805A

United States Patent [19]

Gumb

[11] Patent Number: 5,172,805

[45] Date of Patent: Dec. 22, 1992

[54] PUSHBUTTON AND CARRYING MEMBER COMBINATION FOR OPERATING AN ELECTRONIC SWITCHING DEVICE

[75] Inventor: Beverley W. Gumb, London, Canada

[73] Assignee: Northern Telecom Limited, Montreal, Canada

[21] Appl. No.: 704,517

[22] Filed: May 23, 1991

[51] Int. Cl.[5] ..... H01H 13/04

[52] U.S. Cl. ..... 200/341; 200/5 A; 200/517; 200/520; 200/293; 200/344; 200/302.002

[58] Field of Search ..... 200/517, 302.2, 303, 200/341, 345, 344, 292, 5 A, 520, 293

[56] References Cited

U.S. PATENT DOCUMENTS

| | | | |
|---|---|---|---|
| 3,887,777 | 6/1975 | Nishino | 200/302.2 X |
| 4,367,384 | 1/1983 | Waarlé | 200/517 |
| 4,527,030 | 7/1985 | Oelsch | 200/517 X |
| 4,556,769 | 12/1985 | Inaba | 200/345 |
| 4,641,004 | 2/1987 | Keprda | 200/302.2 X |
| 4,733,036 | 3/1988 | Koizumi et al. | 200/517 |
| 4,786,766 | 11/1988 | Kobayashi | 200/5 A |
| 4,927,990 | 5/1990 | Aoki et al. | 200/517 |

FOREIGN PATENT DOCUMENTS

| | | | |
|---|---|---|---|
| 3405652 | 8/1985 | Fed. Rep. of Germany | 200/344 |
| 2046996 | 11/1980 | United Kingdom | 200/341 |

*Primary Examiner*—Ernest G. Cusick
*Attorney, Agent, or Firm*—R. J. Austin

[57] ABSTRACT

A pushbutton and cover combination for operating an electronic switching device, such as a telephone or keypad. The cover defines a number of button receiving apertures extending therethrough. Each button comprises a body having a first part which provides a contact surface and a second part which is slidably received through an individual one of the apertures, so that the contact surface of the button is accessible from a first side of the cover. Latches on the second part of the button body are cooperable with the cover so that the button is held captive in the cover, with the second part of the body being operable to move slidably within the aperture, for engaging a flexible barrier layer and operating the electronic switching device on an underlying circuit board. The subassembly of the cover with the captive buttons is removable intact from the circuit board and flexible barrier layer of the electronic switching device. After removal of the subassembly, the latches are accessible and the buttons are removable from the cover.

21 Claims, 3 Drawing Sheets

PUSHBUTTON AND CARRYING MEMBER COMBINATION FOR OPERATING AN ELECTRONIC SWITCHING DEVICE

This invention relates to pushbutton and carrying member combinations for operating electronic switching devices.

Pushbuttons for operating electronic switching devices, for example, as used in telephones and keypads, are supplied conventionally as part of a sealed assembly of one or more pushbuttons with a housing and a circuit board carrying an electronic switching device. The sealed assembly is mounted within an exterior housing of the telephone or keypad with the buttons extending through correspondingly arranged apertures in the exterior housing. If a button or the assembly suffers damage or requires repair the assembly including the circuit board carrying the switching device, must be removed from the telephone or keypad for replacement or for disassembly and repair.

In use, pushbutton assemblies in telephones and keypads may be subjected to accidental liquid spills, for example beverages, and outdoors exposure to rain and other contaminants. As disclosed in copending U.S. patent application, Ser. No. 541,857 (Canadian Serial No. 2.019.448-1) to G. Kuhfus, for Telephone Terminal Bases, a button assembly for a telephone is described in which a flexible barrier layer is provided within the button assembly, the barrier layer being located between a set of pushbuttons and electronic switch contacts on a circuit board of the assembly. The barrier layer forms part of the switches underlying the buttons, having regions aligned with the buttons which are selectively and resiliently deformable by a corresponding button to bridge and close the corresponding spaced contacts on the circuit board. The barrier layer sealingly engages an exterior housing of the telephone and is cooperable with the exterior housing to provide for drainage of liquid which may enter the assembly from apertures around the buttons and seep onto the barrier layer, so that liquid may drain out of the telephone through drainage holes in the exterior housing without damaging the underlying switching contacts and other electronic components. However, a pushbutton may subsequently stick because of residue left around the button when the liquid dries and consequently the sealed button assembly must be dismantled for repair or replaced, as mentioned above.

Other prior art means to protect button assemblies on electronic keyboards from liquid spills comprise a flexible barrier layer of a elastomeric material over the button assembly on the outside of the housing, through which the buttons of the assembly may be operated. However, these protective covers are generally unaesthetic and, if they are thick enough to withstand wear, may interfere with operation of the buttons.

The present invention seeks to provide a pushbutton and carrying member combination for operating an electronic switching device which in use, avoids or reduces the above problems.

According to one aspect of the present invention, there is provided a pushbutton and carrying member combination for operating an electronic switching device, comprising: a carrying member, a plurality of buttons slidably extending into apertures within the carrying member with a contact surface of each button accessible from a first side of the carrying member, each button and the carrying member having cooperable retaining means for holding the buttons captive in the carrying member with each button being operable to move slideably within a corresponding aperture for engaging and operating the electronic switching device.

More particularly, according to a further aspect of the present invention there is provided a pushbutton and carrying member combination for operating an electronic switching device, comprising: a carrying member having a first side and another side and defining a plurality of apertures extending therethrough and a plurality of buttons, each button comprising a body having a first part providing a contact surface and a second part of the body being slideably receivable in an individual one of said apertures through the carrying member whereby the contact surface is accessible from the first side of the carrying member, the second part of the body of each button and the carrying member having cooperable retaining means for holding the button captive in the carrying member with the second part of the button body being operable to move slideably within the aperture for engaging and operating the electronic switching device.

Thus the buttons are held captive in a carrying member, which may be separate from the electronic switching device and may, for example, comprise a cover or part of an exterior housing of a telephone or a housing of a button assembly. The carrying member and the buttons are thus removable together from the switching device to allow for cleaning or repair of the buttons separately from the switching device.

Advantageously the retaining means is operable to enable a button to be removed from or installed in the carrying member. Thus the buttons may be individually removed from the carrying member for cleaning or replacement.

In an advantageous structure of the combination, when a button is slideably received within an aperture and held captive in the carrying member with the contact surface accessible from the first side of the carrying member, the retaining means is accessible from the other side of the carrying member to be operable to enable the button to be removed. Thus the retaining means is inaccessible from the first side to prevent accidental removal of the buttons.

The retaining means conveniently comprises a resilient latch means having at least one latch extension of the carrying member and latch receiving space formed in the second part of the body. This structure may be manufactured easily by molding from a plastic material.

According to yet a further aspect of the present invention there is provided an assembly of pushbuttons and a carrying member with an electronic switching device comprising: a circuit board carrying at least part of an electronic switching device; a flexible barrier layer overlying the circuit board and said part of the electronic switching device; and, a subassembly comprising a carrying member and a plurality of buttons, the carrying member having a first side and another side and defining a plurality of apertures extending therethrough, and each button comprising a body having a first part providing a contact surface and a second part of the body being slideably received through an individual one of said apertures through the carrying member whereby the contact surface is accessible from the first side of the carrying member; the second part of the body of each button and the carrying member having cooperable retaining means whereby each button is captive in the carrying member with the second part of the body being operable to move slideably within the aperture for engaging the flexible barrier layer and operating the underlying electronic switching device, the subassembly with the buttons captive in the carrying member being removable intact from the circuit board and flexible barrier layer of the electronic switching device.

In an advantageous assembly of pushbuttons and a carrying member with an electronic switching device, e.g. a keypad of a key board or a telephone instrument, the carrying member forms part of the housing of the instrument, i.e. a cover, and the buttons are detachably captive in the cover. Removal of the cover provides access to the switching assembly with the barrier layer overlying the switching contacts on the circuit board. Each button is then separately removable from the carrying member for cleaning or replacement. Preferably the buttons are captive in the carrying member with latch means operable only from within the housing so as to be tamper proof and not easily removed from the assembled housing, so as to reduce risk of accidental loss of the buttons, while providing for easy removal of a button for repair or cleaning by service personnel after removing the cover from the keyboard or telephone instrument. Furthermore, the switching assembly can be exposed for maintenance or cleaning on-site, and the cover replaced without need to send the unit to the workshop for disassembly and replacement of the button assembly. In a preferred arrangement, the barrier layer is cooperable with drainage holes in the carrying member to provide drainage of liquid through the carrying member while sealing the electronic switching device from liquid infiltration.

Thus, the pushbutton and carrying member combination of the present invention overcomes problems of cleaning and maintenance of pushbutton assemblies of known structure.

Embodiments of the invention will now be described by way of example, with reference to the accompanying drawings, in which.

Figure 1A:
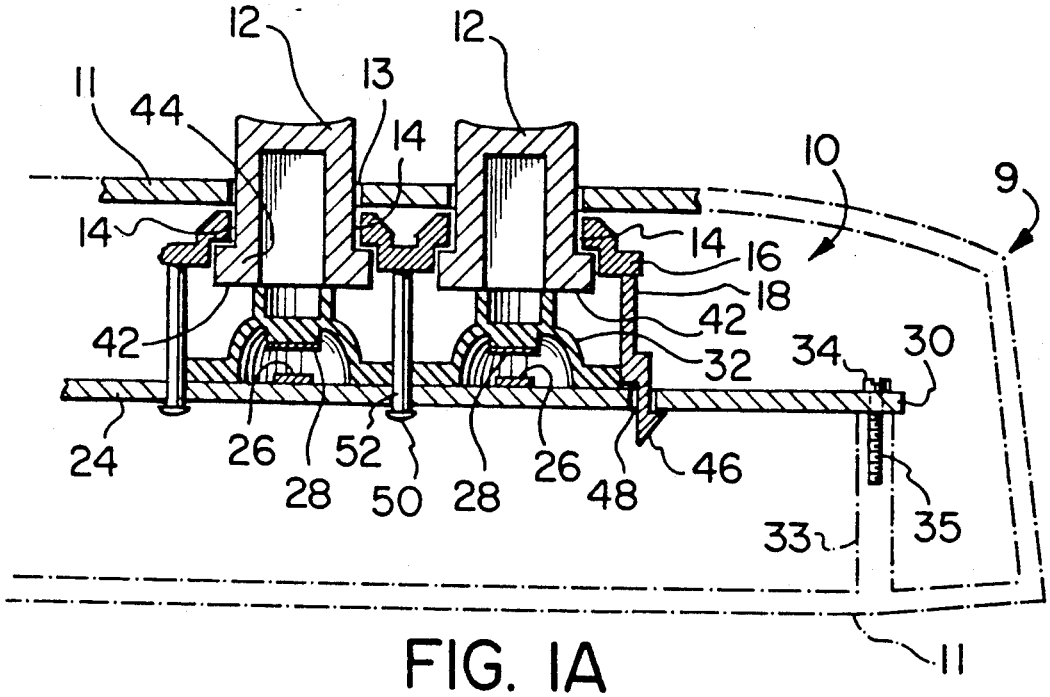
FIG. 1A PRIOR ART
FIG. 1A is a partially sectional side view of part of a pushbutton assembly of prior art structure mounted within a telephone.
Figure 1B:
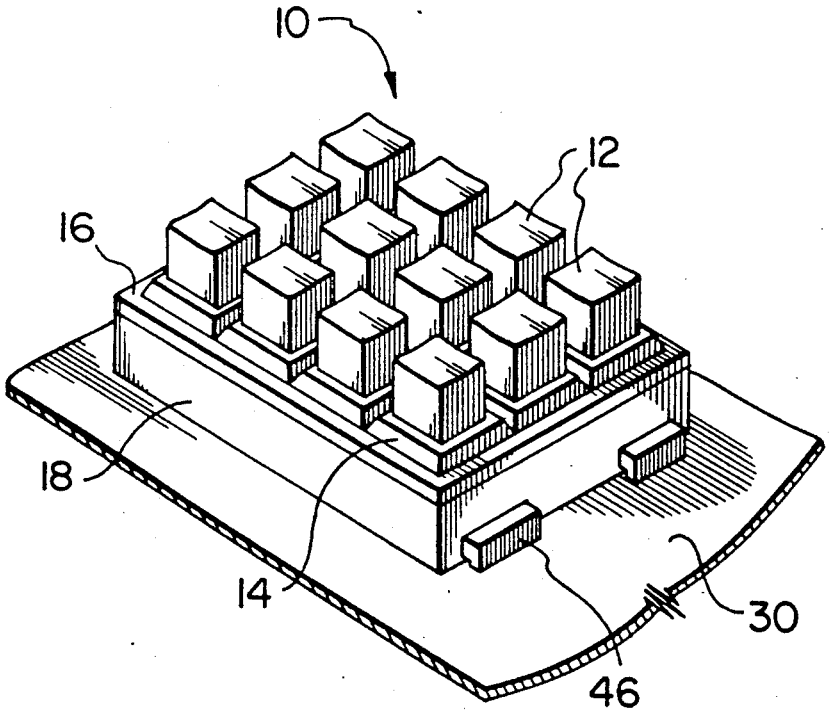
FIG. 1B PRIOR ART
FIG. 1B is a perspective view of the assembly of FIG. 1A.

A pushbutton assembly 10 of known structure, is shown in FIG. 1A, mounted within an exterior housing 11 of a telephone 9 indicated by the chain dotted outline. The assembly 10 is a sealed unit, FIG. 1B, comprising a plurality of pushbuttons 12 associated with a circuit board 30 which provides an electronic switching device, and a housing 18 of the assembly. For example, a standard telephone keypad as shown in FIG. 1B comprises an 3×4 array of twelve buttons 12. The buttons 12 operate the electronic switching device comprising a set of electronic switches 20, each switch comprising pairs of spaced apart switch contacts 26 and corresponding bridging contacts 28, FIG. 1A. The switch contacts 26 are provided by part 24 of the printed circuit board 30. The bridging contacts 28 are provided on a resiliently flexible barrier layer 32 overlying the printed circuit board 30. A button is associated with each switch 20 and the buttons are located within corresponding apertures 14 in a cover 16 of the housing 18 of the assembly 10. The buttons 12 each comprise a body having a first part 38 providing a contact surface 40 for manually depressing the button and a second part 42 slideably extending through the corresponding aperture 14 in the cover 16 for operating the electronic switches 20 as will be described below. Each button 12 is retained within the housing 18 by lateral extensions 44 of the button body which provide abutment surfaces to engage the housing cover 16 around apertures 14. The circuit board 30, which forms part of the assembly, may also carry other electronic components of the telephone, and is mounted within the exterior housing 11 of the telephone base, for example, with screws 34 engaging screw receiving holes 35 of spacers 33 within the housing 11. The housing 11 of the telephone base is provided with a plurality of, i.e. twelve apertures 13, aligned with and providing access to the twelve buttons 12 of the pushbutton assembly 10.

Depression of a button 12 causes the second part 42 of the body to engage and resiliently and selectively deform an area of the underlying elastomeric barrier layer 32 moving a corresponding bridging contact 28 towards the underlying spaced apart switch contact pair 26, thereby making contact between the pair of switch contacts 26. On releasing the button 12, the resiliently flexible barrier layer 32 resiliently returns the bridging contact 28 to the open position with the contacts resiliently biased apart.

The housing 18 of the button assembly is positioned on the circuit board by means of resilient latches 46 extending through holes 48 in the circuit board, and pegs 50 which protrude through corresponding holes 54 in the elastomeric barrier layer 32 and through corresponding holes 52 in the circuit board. The housing 18 is heat staked to the board by heating and deforming ends of the pegs 50 as shown in FIG. 1 to prevent their removal from the board 30. Thus the switch assembly is permanently affixed to a circuit board within the housing 18 and any repair necessitates return of the telephone to a repair shop for disassembly of the button assembly and replacement. Any liquid spilt on the telephone may seep around the buttons into the sealed button assembly and through alignment holes 54 in the resilient barrier layer and damage underlying electronic components on the printed circuit board. In addition, the buttons and cover cannot be easily cleaned of beverage residue to prevent sticking of buttons without further liquid passing through to the barrier layer 32. Hence for cleaning purposes and during repair, upon removal of the cover 16 from the button assembly 10, the buttons 12 are loose and fall out from the assembly.

Figure 2:
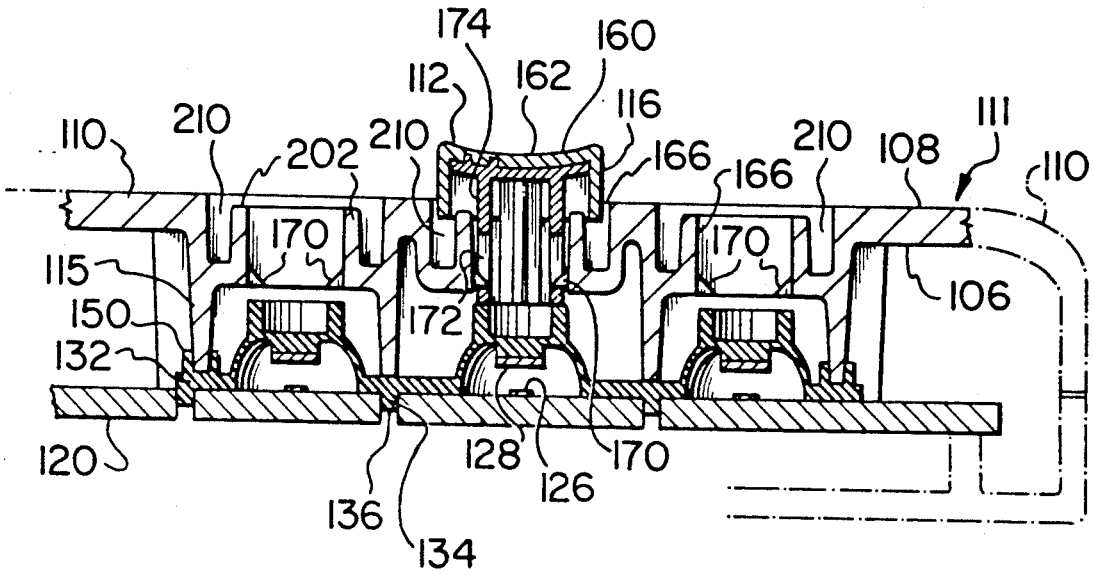
FIG. 2 is a cross-sectional view of a pushbutton and carrying member combination as part of a telephone base and according to an embodiment of the present invention.
Figure 3A:
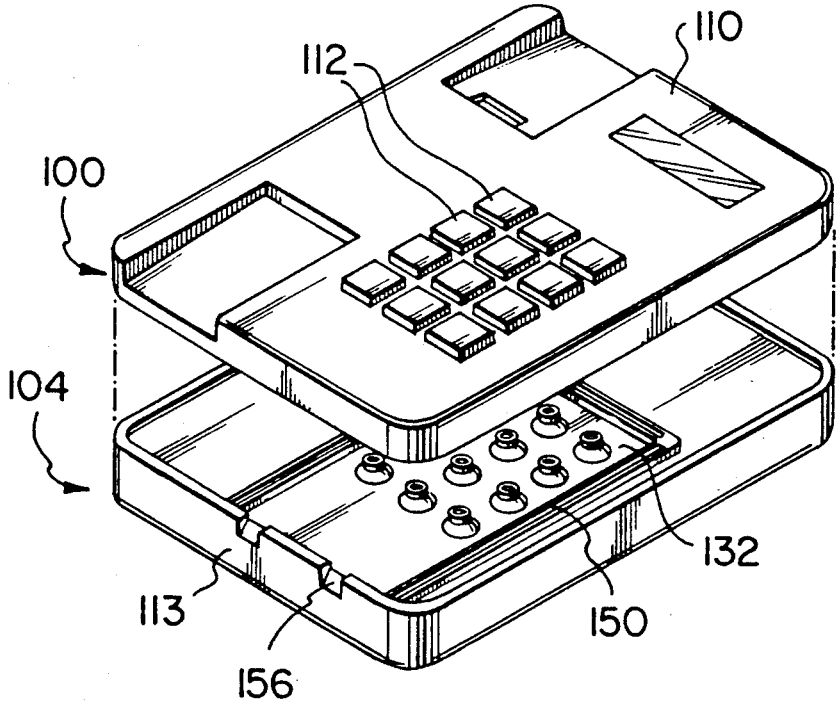
FIG. 3 is perspective view (A) and a partly cut away side view (B) of an assembly according to the embodiment.
Figure 3B:
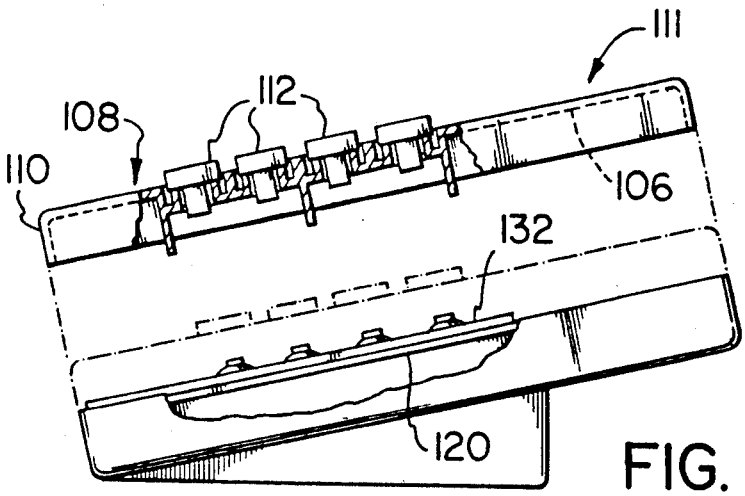
Figure 4:
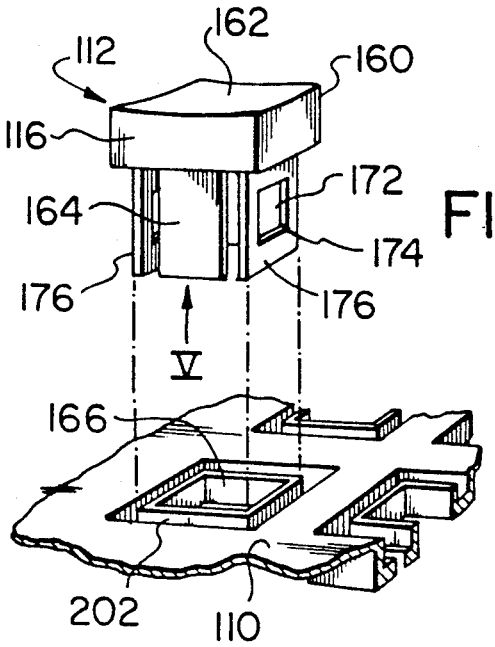
FIG. 4 is a perspective view of a pushbutton and part of a carrying member forming part of the embodiment.
Figure 5:
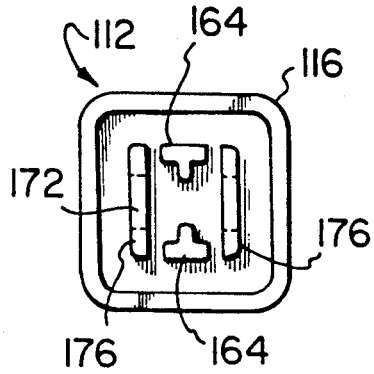
FIG. 5 is a view of a button along arrow V of FIG. 4.
Figure 6:
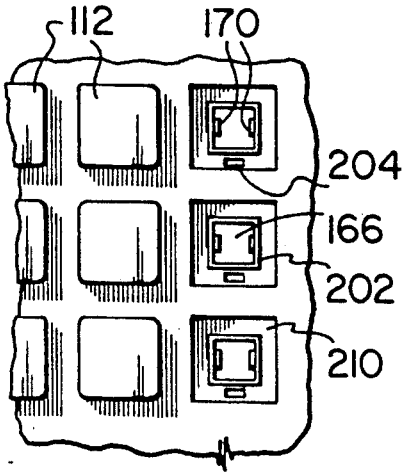
FIG. 6 is a top view of part of a pushbutton and carrying member combination according to the embodiment.

A pushbutton and carrying member combination 100 according to an embodiment of the present invention, is shown in FIGS. 2 to 6, where it is shown as a subassembly 111 of a telephone base. The telephone base has an exterior housing 104 comprising a housing base 113 and carrying member which forms a cover 110 of the telephone base. The cover 110 has a first, or exterior, side 108, and another side 106, facing inside the housing. The cover 110 defines a plurality of apertures 166 therethrough, i.e. twelve apertures for receiving twelve buttons 112 having a conventional telephone keypad arrangement, as illustrated in FIG. 3A. Each button 112 comprises a first part 160 providing a contact surface 162 for operating the button by manual depression of the button and a second part 164 of the body (FIG. 4). The second part 164 of the body is slideably receivable within a corresponding aperture 166 through the cover 110. The second part 164 of each button body and the cover 110 together provide cooperable retaining means in the form of resilient latch means for holding each button captive in the cover. The latch means comprises a pair of latch extensions 170 of the cover 110 for engaging corresponding latch receiving spaces 172 formed through opposite cantilevered sidewalls 176 of the second part 164 of the button body. The sidewalls 176 are resiliently deformable for releasing the latches. Abutment surfaces 174 of side walls 176 of the second part 164 engage the resilient latch extensions 170 of the cover to retain the button within the cover 110.

The telephone base, as illustrated in FIGS. 2 and 3, includes a switching device, similar to that of the prior art, comprising a set of first switch contacts 126 arranged in pairs and provided on part of a circuit board 120 and a corresponding second set of bridging contacts 128, each bridging contact 128 for making or breaking contact between the contacts 126 of a respective pair. The contacts 128 are carried by a resiliently flexible barrier layer 132 overlying the circuit board. The combination 100 of the cover 110 and the buttons 112, which forms a subassembly, overlies said part of the circuit board 120 and each button is aligned with a corresponding bridging contact 128 of the switching device. Each button body is operable by manual depression of the button to slide within its corresponding aperture 166 and cause the corresponding contact 128 to make contact with the corresponding pair 126, as in the prior art button assembly.

However, because of the latch extensions 170 and latch receiving spaces 172, the buttons of the present embodiment are retained within the apertures of the cover 110 rather than being retained within a separate sealed button assembly. Thus on removal of the cover 110 from the telephone base, the buttons 112 are retained by the cover 110 and are held captive in the cover, so that the barrier layer 132 of the underlying switch mechanism is exposed within the housing base 113 of the telephone (FIGS. 2 and 3). Thus the cover and the buttons may be removed as the complete subassembly 100 by service personnel and washed under the tap to remove residue. Also, after removal of the subassembly 100, the resilient latch means retaining the buttons in the cover are then accessible from the other side 106 of the cover and are operable to release the buttons 112, i.e. by manually pressing together opposite side walls 176 of the second part 164 of a button body to release latch extensions 170 and allow the button body to be pushed outwards and disengaged from and removed from the first side 108 of the cover. Thus the button may be removed by service personnel for cleaning off residue of liquids spilt on the telephone which may cause buttons to bind or stick in the apertures 166. However, because the latch means is operable from the other side 106 of the cover 110, the buttons cannot be removed from first side 108, i.e. the exterior, without removal of the cover from the telephone. Thus the retaining means are tamper resistant and child proof to reduce unauthorized or accidental removal of buttons.

A wall means 116 of the first part 160 extends around the second part 164 of the button body and extends in the direction of and is outwardly spaced from the second part 164. The cover 110 is formed with recesses 210 opening onto the side 108 around the button receiving apertures 166 for acceptance of the wall means 116, the recesses 210 and apertures 166 being separated by walls 202. Drainage holes 204 (FIG. 6) through the cover 110 are provided in the recesses 210, to allow liquid to drain from each recess through the holes 204 onto the underlying barrier layer 132 (FIG. 2). The barrier layer is similar to that of the prior art except that instead of means for location of the elastomeric barrier layer 132 on the circuit board 120 comprising holes in the barrier for engagement with pins on the circuit board, alignment means are provided in the embodiment by protrusions 134 of the barrier layer which are received into corresponding holes 136 in the circuit board. Thus the barrier layer 132 does not have apertures therethrough to permit seepage of liquid to the underlying electronic components of circuit board. The barrier layer has sidewalls or ribs 150 forming a groove extending around its perimeter receiving ribs 115 of the cover to form a seal for containing liquid on the barrier layer and directing liquid towards drainage apertures 156 in the base 113 of the exterior housing 104 of the telephone.

Thus the barrier layer prevents drainage of liquid seeping into the button assembly except through predetermined drainage means which are provided to allow liquid to be directed out of the telephone housing without damaging electronic components of the telephone.

Any liquid from, for example a cup of coffee split on the telephone housing, will be directed over surfaces 162 of the buttons into the recesses 210 and via the above mentioned drainage holes 204 out of the housing at drainage apertures 156, without exposure of the electronic circuitry to contamination or damage. The bottoms of recesses 210 serve to collect viscous residues of liquids so as to restrict flow of these residues onto the barrier layer 132. It is then possible, without disassembly of other components of the telephone base, to remove the cover and button subassembly 100 for cleaning under running water. Furthermore, it is possible to rinse the subassembly 100 while it is in place in the telephone, for example, by placing part of the telephone under running water to rinse out any sticky residue around the buttons which may be interfering with operation of the button assembly, any excess water being allowed to drain through the drainage holes 204, over the barrier layer 132 and out of the housing through drainage apertures 156.

A further advantage is provided by the subassembly of the present invention for servicing or repair. Removal of the cover and the buttons from the telephone with the buttons held captive within the cover conveniently prevents loss of loose buttons during servicing. In addition, by holding the buttons in the outer housing of the phone itself, removal of the cover of the housing exposes the elastomeric barrier layer with the underlying switches. The barrier layer may be cleaned in situ or removed for cleaning or replacement. The button assembly of the invention thus provides for rapid and easy on-site repair.

In a modification of the combination of the embodiment (not shown), a carrying member provides part of a housing of a button assembly which is removably attached to a circuit board of the assembly by latches, and which is itself contained within an exterior housing of the telephone. After removal of a cover of the telephone, the carrying member and buttons may be removed together as a subassembly from the barrier layer.

In another modification of the combination of the embodiment, also not shown, the carrying member comprises an insert portion of cover of an exterior housing of a telephone base.

What is claimed is:

1. An assembly of pushbuttons and a carrying member with an electronic switching device comprising:

a circuit board carrying at least part of an electronic switching device;

a flexible barrier layer overlying the circuit board and said at least part of an electronic switching device; and, a sub-assembly comprising a carrying member and a plurality of buttons, the carrying member having a first side and another side, and defining a plurality of apertures extending therethrough, and each button of said plurality of buttons comprising a body having a first part providing a contact surface and a second part of the body being slideably received through an individual one aperture of said plurality of apertures, the first part of each button body comprises a wall surrounding and spaced from the second part, and the first side of the carrying member around each one aperture defines a recess spaced from and surrounding said one aperture with said wall received within said recess, whereby the contact surface is accessible from the first side of the carrying member, the sub-assembly being mounted with the other side of the carrying member facing the barrier layer, the second part of the body of each button and the carrying member having cooperable retaining means whereby each button is releasably captive in the carrying member with said second part of the body being operable to move slideably through the aperture for engaging the flexible barrier layer and operating said at least part of an electronic switching device, and the sub-assembly with the buttons releasably captive in the carrying member being removable intact from the flexible barrier layer and the circuit board.

2. An assembly according to claim 1 wherein the carrying member defines in each said recess a drainage hole through the carrying member and the flexible barrier layer is cooperable with the carrying member to form a liquid barrier whereby liquid may drain through the drainage hole onto the underlying flexible barrier layer and be prevented from contacting said electronic switching device.

3. An assembly according to claim 1 wherein the carrying member comprises part of a housing of said electronic switching device, and another part of the housing comprises holes through the housing for drainage of liquid which has drained through said drainage hole in said recess and onto the barrier layer.

4. An assembly according to claim 1 wherein the retaining means comprises a resilient latch.

5. An assembly according to claim 4 wherein, in respect of each button, the resilient latch comprises at least one latch extension of the carrying member and the second part of the body of each button comprises a sidewall defining a corresponding latch receiving space, said sidewall being resiliently deflectable away from the latch extension for releasing the latch.

6. A pushbutton and carrying member combination for operating an electronic switching device, comprising:

a carrying member having a first side and an other side and defining a plurality of apertures extending therethrough; and a plurality of buttons;

each button of said plurality of buttons comprising a body having a first part providing a contact surface and a second part of the body being slideably receivable within an individual one aperture of said plurality of apertures through the carrying member, whereby the contact surface is accessible from the first side of the carrying member, the second part of the body comprising a sidewall whereby when the button is received within said one aperture, the second part of the body is operable to move slideably within the one aperture with the sidewall extending through said one aperture for engaging and operating an electronic switching device on said other side of the carrying member, said sidewall and the carrying member having cooperable retaining means for holding the button releasably captive in the carrying member with the button being removable from the first side of the carrying member by resiliently deforming said sidewall from the other side of the carrying member to release the retaining means.

7. A pushbutton and a carrying member combination according to claim 6 wherein the retaining means comprises a resilient latch.

8. A pushbutton and a carrying member combination according to claim 7 wherein the resilient latch comprises at least one latch extension of the carrying member and a corresponding latch receiving space in said sidewall, said sidewall being resiliently deflectable for releasing the latch.

9. A pushbutton and a carrying member combination according to claim 6 wherein the first part of the body of each button comprises a wall surrounding and spaced away from the second part, and the one side of the carrying member around each individual one aperture of said plurality of apertures defines a recess spaced from and surrounding said one aperture for acceptance of said wall of a button.

10. A pushbutton and a carrying member combination according to claim 9 wherein said recess is formed with a drainage hole through the carrying member.

11. A pushbutton and a carrying member combination according to any one of claims 6, 8, 9 and 10 wherein the carrying member comprises part of an exterior housing of an electronic switching device.

12. An assembly of pushbuttons and a carrying member with an electronic switching device comprising:

a circuit board carrying at least part of an electronic switching device;

a flexible barrier layer overlying the circuit board and said at least part of an electronic switching device; and, a sub-assembly comprising a carrying member and a plurality of buttons, the carrying member having a first side and another side, and defining a plurality of apertures extending therethrough; and each button of said plurality of buttons comprising a body having a first part providing a contact surface and a second part of the body being slideably received through an individual one aperture of said plurality of apertures through the carrying member whereby the contact surface is accessible from the first side of the carrying member;

the subassembly being mounted with the other side of the carrying member facing the barrier layer, the second part of the body being operable to move slideably within the aperture and comprising a sidewall extending through the aperture for engaging the flexible barrier layer and operating an underlying electronic switching device, said sidewall and the carrying member having cooperable retaining means whereby each button is releasably captive in the carrying member, the sub-assembly with the plurality of buttons captive in the carrying member being removable intact from the circuit board and the flexible barrier layer whereby the retaining means are accessible and releasable from said other side of the carrying member by resiliently deforming said sidewall to allow removal of a button from the first side of the carrying member.

13. An assembly according to claim 12 wherein the retaining means comprises a resilient latch.

14. An assembly according to claim 13 wherein, in respect of each button, the resilient latch comprises at least one latch extension of the carrying member and a corresponding latch receiving space in said sidewall, said sidewall being resiliently deflectable away from the latch extension for releasing the latch.

15. An assembly according claim 12 wherein the first part of each button comprises a wall surrounding and spaced from the second part; and the first side of the carrying member around each one aperture of said plurality of apertures defines a recess spaced from and surrounding said one aperture with the wall of a respective button received within said recess.

16. An assembly according to claim 15 wherein the carrying member defines in said recess a drainage hole through the carrying member and the flexible barrier layer is cooperable with the carrying member to form a liquid barrier whereby liquid may drain through the drainage hole onto the underlying flexible barrier layer and be prevented from contacting the electronic switching device.

17. An assembly according to claim 16 wherein the carrying member comprises part of a housing of the electronic switching device, and another part of the housing comprises holes through the housing for drainage of liquid which has drained through a drainage hole and onto the barrier layer.

18. A pushbutton and carrying member combination for operating an electronic switching device, comprising:

a carrying member having a first side and an other side and defining a plurality of apertures extending therethrough, and a plurality of buttons, each button of said plurality of buttons comprising a body having a first part providing a contact surface and a second part of the body being slideably receivable in an individual one aperture of said plurality of apertures through the carrying member, the first part of the body comprising a wall surrounding and spaced away from the second part of the body, and the first side of the carrying member around each individual one aperture defining a recess spaced from and surrounding said one aperture for acceptance of said wall of a button, whereby the contact surface is accessible from the first side of the carrying member, and, the second part of the body of each button and the carrying member having cooperable retaining means for holding the button releasably captive in the carrying member with the second part of the button body being operable to move slideably through the one aperture for engaging and operating an electronic switching device.

19. A pushbutton and carrying member combination according to claim 18 wherein said recess is formed with a drainage hole through the carrying member.

20. A pushbutton and carrying member combination according to claim 18 wherein the retaining means comprises a resilient latch.

21. A pushbutton and carrying member combination according to claim 20 wherein the resilient latch comprises at least one latch extension of the carrying member and the body of a each button provides a sidewall having a corresponding latch receiving space, the sidewall being resiliently deflectable for releasing the latch.

* * * * *